US007252605B2

(12) United States Patent
Snider

(10) Patent No.: US 7,252,605 B2
(45) **Date of Patent: *Aug. 7, 2007**

(54) ARTICULATED FOOTBALL GOAL INCLUDING SACRIFICIAL CROSSBAR

(76) Inventor: James L. Snider, 122 Allison Ave., Bridgeport, WV (US) 26330

( * ) Notice: Subject to any disclaimer, the term of this patent is extended or adjusted under 35 U.S.C. 154(b) by 217 days.

This patent is subject to a terminal disclaimer.

(21) Appl. No.: 10/942,701

(22) Filed: Sep. 16, 2004

(65) Prior Publication Data

US 2005/0037875 A1 Feb. 17, 2005

Related U.S. Application Data

(63) Continuation-in-part of application No. 10/779,833, filed on Feb. 17, 2004, now Pat. No. 6,945,885.

(60) Provisional application No. 60/449,480, filed on Feb. 21, 2003.

(51) Int. Cl.
*A63B 63/00* (2006.01)

(52) U.S. Cl. ..... 473/477

(58) Field of Classification Search ..... 473/477, 473/476, 472, 479, 484, 485, 486, 488, 447
See application file for complete search history.

(56) References Cited

U.S. PATENT DOCUMENTS

| | | | | |
|---|---|---|---|---|
| 648,512 | A * | 5/1900 | Manley | 473/477 |
| 2,884,252 | A * | 4/1959 | Thompson | 473/477 |
| 2,929,630 | A * | 3/1960 | Simmons | 473/477 |
| 3,516,666 | A | 6/1970 | Trimble et al. | |
| 3,675,922 | A * | 7/1972 | Nieland | 473/420 |
| 3,908,992 | A | 9/1975 | Cunningham et al. | |
| 3,981,501 | A | 9/1976 | Gonzalez et al. | |
| 4,026,554 | A * | 5/1977 | Karkoska | 473/477 |
| 4,465,277 | A * | 8/1984 | Dittrich | 473/447 |
| 5,601,284 | A | 2/1997 | Blackwell et al. | |
| 5,738,601 | A | 4/1998 | Hughes | |
| 5,839,980 | A | 11/1998 | Kendy | |
| 6,261,196 | B1 | 7/2001 | Caruso | |
| 6,302,811 | B1 | 10/2001 | Topham | |
| 6,394,917 | B1 | 5/2002 | Chiappini | |
| 6,402,643 | B1 | 6/2002 | Gill | |
| 6,672,980 | B1 | 1/2004 | Walsh | |
| 6,945,885 | B2 * | 9/2005 | Snider | 473/477 |

* cited by examiner

*Primary Examiner*—Eugene Kim
*Assistant Examiner*—M. Chambers
(74) *Attorney, Agent, or Firm*—William L. Krayer

(57) ABSTRACT

An articulated athletic goal can be raised to a high position and/or a low position relative to the game position, for safety and security. The crossbar and uprights are supported on the end of a boom pivoted on a vertical column and powered by a hydraulic actuator, which may be operated remotely. Through either a parallel linkage or a separate hydraulic actuator, the uprights are held in a substantially vertical orientation throughout the pivoting motion. In a preferred embodiment, the boom is mounted on a single pivot and articulation enables the boom to be oriented substantially vertically downward. The boom is provided with a second, smaller, actuator, for releasing the crossbar/upright assembly when it is near the field, completely separating the crossbar/upright assembly from the boom. The sacrificial crossbar/upright assembly may then be removed by spectators without the dangerous and destructive mob action previously associated with after-game celebrations. A replacement crossbar/upright assembly is easily attached and readied for the next use.

13 Claims, 18 Drawing Sheets

ARTICULATED FOOTBALL GOAL INCLUDING SACRIFICIAL CROSSBAR

RELATED APPLICATION

This is a continuation-in-part of my application Ser. No. 10/779,833 filed Feb. 17, 2004 titled "Articulated Football Goal Post" now U.S. Pat. No. 6,945,885, which in turn claims the full benefit of my Provisional Application 60/449,480 filed Feb. 21, 2003, titled "Hydraulically Actuated Football Goal Post."

FIELD OF THE INVENTION

The invention relates to football goals, particularly to a goal that can be adjusted in height and otherwise manipulated for improved safety and security, and readily placed in condition for use according to standard rules. In one embodiment, the crossbar and uprights can be lowered to the field for quick release or disassembly.

BACKGROUND OF THE INVENTION

Rabid and out-of-control spectators and/or students at many football and other sporting events have frequently surged onto the field to destroy or topple the goal posts, presenting serious threats to human life, physical injuries, damage to and destruction of property, theft, and great expense in repairing and replacing the goal posts. Many presently existing goal posts are not easily removed or damaged, but some spectators have proven determined and innovative in carrying out their objective of destruction, sometimes bringing ropes, ladders and other equipment to aid in their endeavors.

A football goal is essentially a horizontal pipe or rod important only for extra points and field goals, not necessary for a touchdown. The horizontal rod or crosspiece must, by rule, be in a certain location and has flanking uprights so the officials can readily see whether a kick passes over it. But the support for the structure can be dangerous to the players as it normally is located near the action of the game.

There is a need for a goal and/or goal post that can safely manipulate the crosspiece to avoid damage by spectators and others, as well as to avoid injury to persons present when a mob is intent on damaging the goal. There is a need also for a goal that can be easily moved from the field for storage, as in the case of a multi-use stadium. And, there is a need for a goal structure that reduces the possibility of players colliding with it and sustaining injuries.

SUMMARY OF THE INVENTION

My invention provides a cross member for an athletic goal which can be hydraulically elevated to a position well beyond the reach of most vandals and others intent on destruction. The goal can be readily lowered as well, permitting the easy installation and maintenance of television cameras and the like. Manipulation of the goal is accomplished from a remote control panel. The crossbar is supported preferably on a heavy steel upright that can optionally be placed farther back from the field than is commonly the case. The entire assembly can be removed from the field for storage.

In one embodiment, the structure comprises a vertical column, a main boom, a nose boom, and a goal element including a crossbar and uprights on the ends of the crossbar. The structure is articulated at both ends of the main boom.

During raising and lowering, the nose boom is caused to remain horizontal, so that the uprights on the ends of the crossbar remain vertical. In aspect of my invention, the vertical column is bolted or otherwise fixed to a concrete base during use. The bolts may be removed, the wiring disconnected, and the vertical column stored in a safe place, while the concrete substructure is covered with a portable supported playing surface.

In another embodiment, there need be only one pivot. From a remote location, a hydraulic powered arm is adapted to lower the crossbar to a point near the field; the crossbar and uprights may then, on a remote signal, be detached from the boom, and the boom can be raised again to its normal height. In one variation of the present invention, then, an object of the invention is to reduce the likelihood of spectator injury by providing a sacrificial crossbar assembly. As will be seen, the boom can be quickly lowered to the field and readily released from the boom, and the boom can then be readily lifted out of reach of a crowd.

DETAILED DESCRIPTION OF THE INVENTION

Figure 1A:
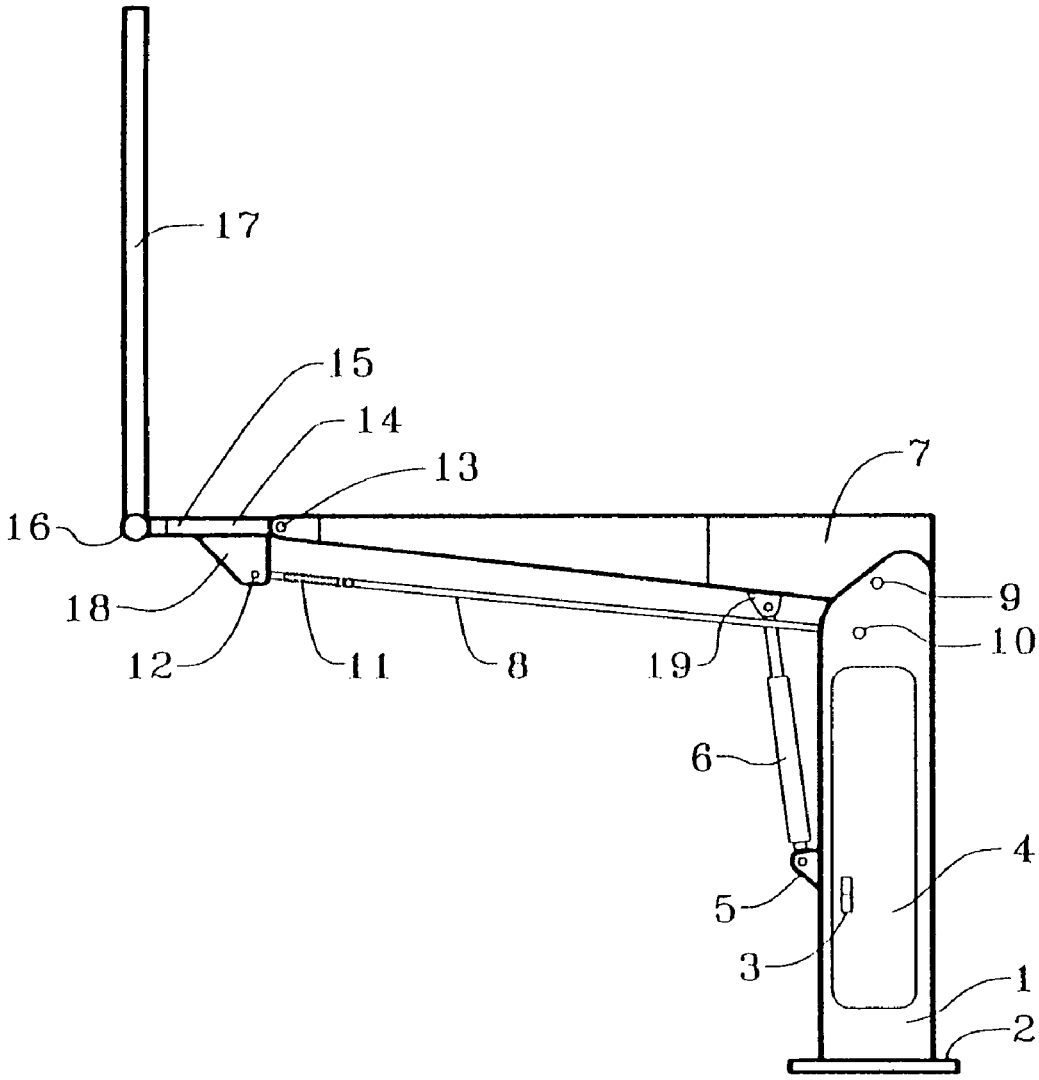
FIG. 1*a* is a side elevational view and FIG. 1*b* is a perspective view of one embodiment of my new goal post, in standard position ready for play.
Figure 1B:
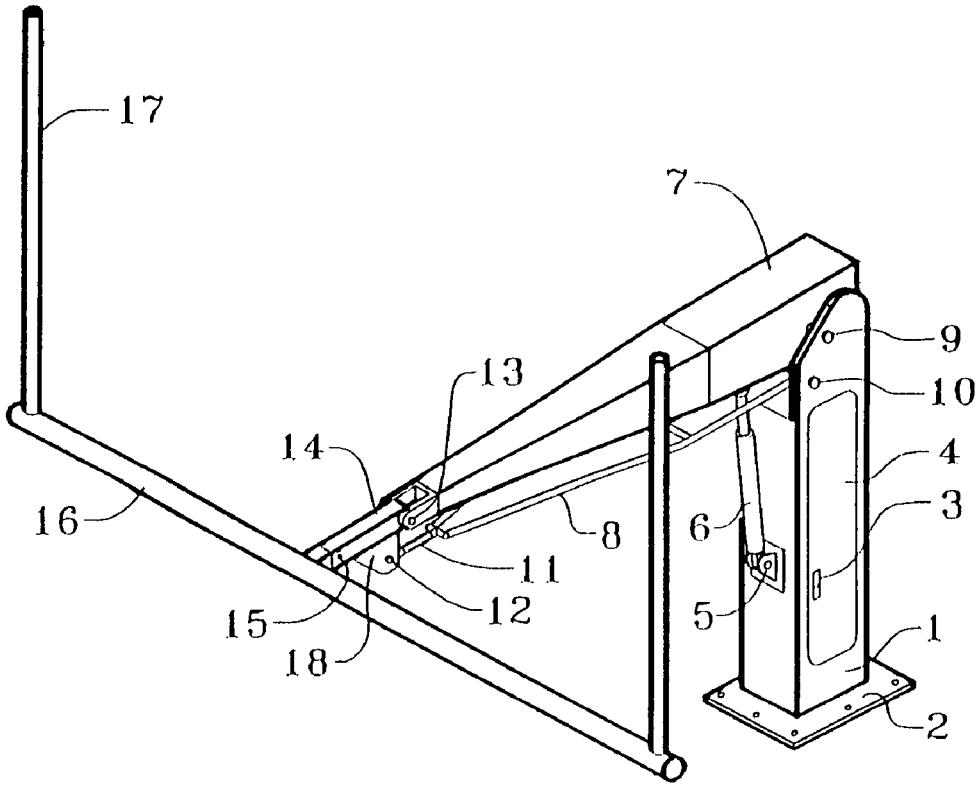
Figure 7:
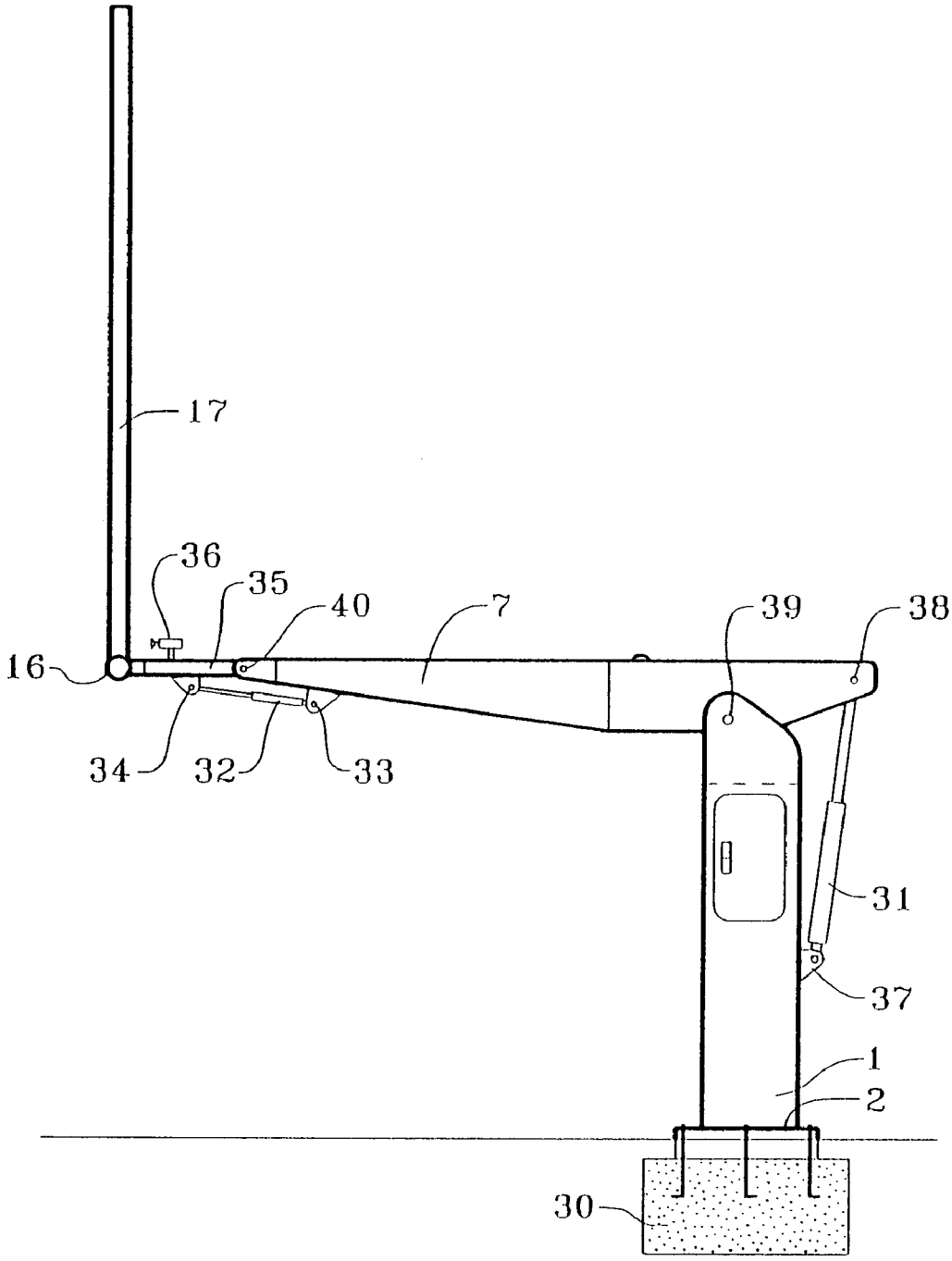
FIG. 7 shows an alternate construction in which the main hydraulic cylinder is in the rear of the vertical column.

Referring first to FIGS. 1*a* and 1*b*, the vertical column 1 rests on base plate 2, which is bolted to a concrete substructure not shown (see item 30 in FIG. 7). Vertical column 1 may be fabricated from 4 pieces of ⅜" mild steel forming the main vertical box structure welded to the base plate 2. Base plate 2 may have, for example, 8¾ inch holes designed for installation of bolts to provide a mechanical, removable connection between the vertical column 1 and the substructure, permitting complete removal of the apparatus from the field. Main boom 7 (sometimes called an arm herein), which may be made of a lighter metal such as aluminum, is connected to the vertical column 1 at pivot 9. Nose boom 14 is connected to main boom 7 through a pivot 13. Beneath nose boom 14 is upper control arm bracket 18. Upper control arm bracket 18 is fixed to nose boom 14 and connected through pivot 12 to control arm 8.

Control arm 8 is adjustable in length by a threaded insert 11. Adjustment of the length of control arm 8 enables adjustment or correction of the vertical orientation of uprights 17 on the ends of crossbar 16. Crossbar 16 is fixed to nose boom 14 through removable pin 15, permitting disassembly of the crossbar from the rest of the structure. Control arm 8 is connected to the vertical column 1 at pivot 10. Hydraulic jack 6 is pivoted and fixed to the vertical column 1 at lower mount 5 and pivoted and fixed to main boom 7 at upper mount 19. Vertical column 1 includes an access door 4 for the hydraulic pump, pump motor and other devices for operating the structure, which will be described in more detail with respect to FIG. 6. Access door 4 has a lockable latch 3.

Crossbar 16 may have nipples or vertical extensions, not shown, for insertion into uprights 17 so they may be easily attached or removed. The uprights 17 may be attached to crossbar 16 in any known acceptable manner. Both the crossbar 16 and uprights 17 may be made preferably of a light metal, but any substantially rigid material will suffice. Whether or not the uprights 17 are tubular, they may be adapted for insertion or attachment, at their upper ends, for wind direction indicators or other devices.

Figure 2A:
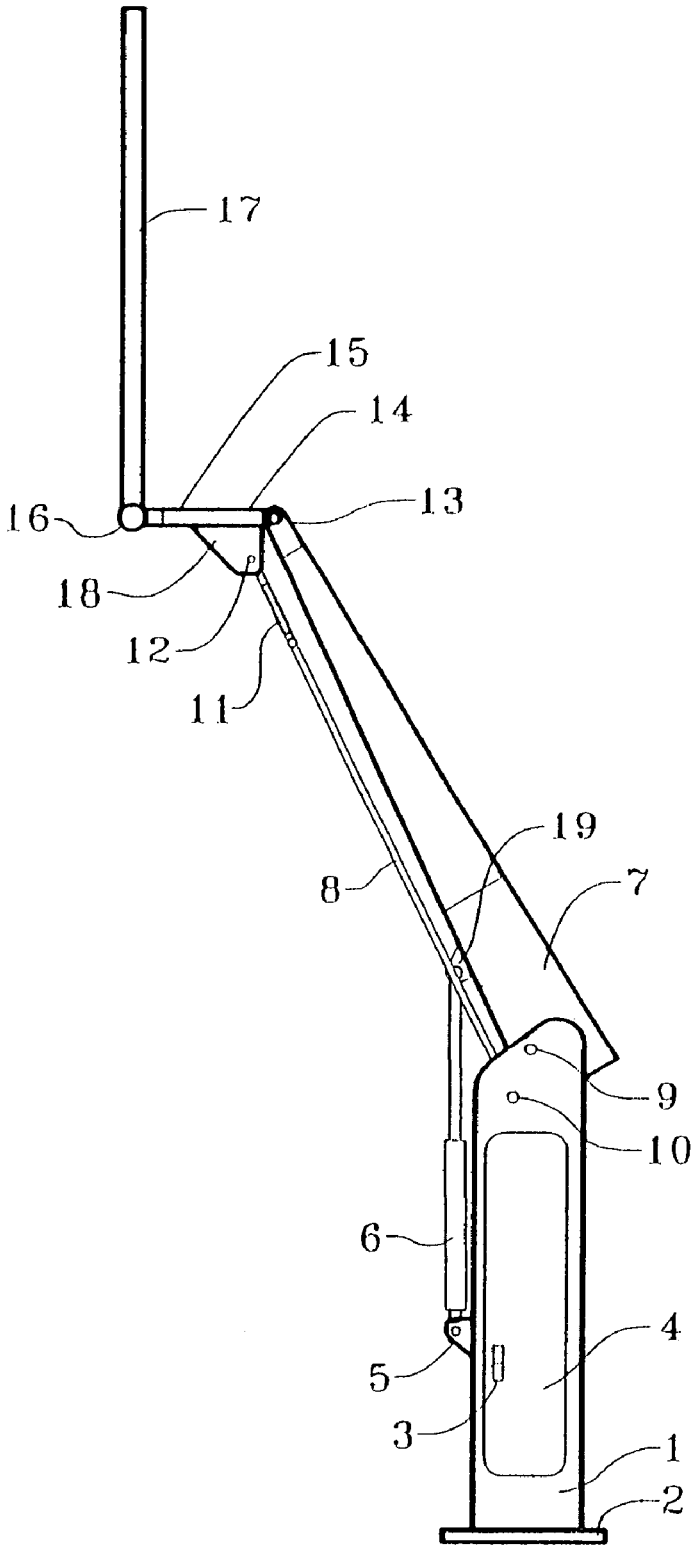
FIGS. 2*a* and 2*b* show the goal in the elevated position.
Figure 2B:
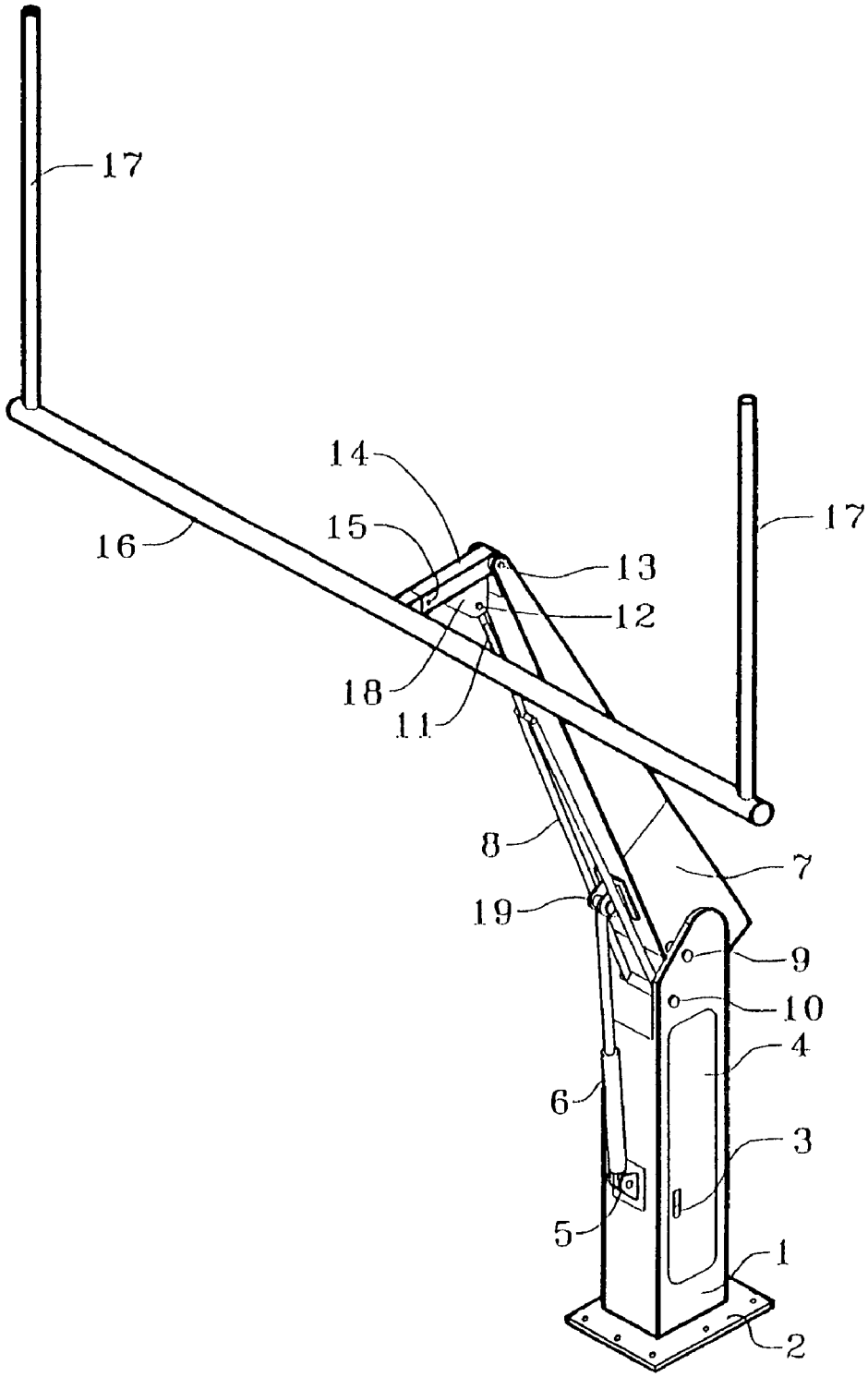

In FIGS. 2*a* and 2*b*, the goal is in the elevated position. In this depiction of the invention, main boom 7 is at an angle about 60 degrees from the horizontal. A particular feature of the invention is that the nose boom 15 is maintained horizontal, so that uprights 17 are maintained in a vertical orientation. It will be observed that control arm 8 is maintained at a constant length and accordingly pivot 12 moves in a substantially circular arc as main boom 7 is elevated, while control arm 8 is also held substantially parallel to main boom 7, resulting in nose boom 14 being held substantially horizontal throughout the elevation of main boom 7 from its generally horizontal orientation of FIGS. 1*a* and 1*b*. A major purpose of elevating the crossbar is to move it far out of the reach of a persons intent on damaging it. Accordingly, the apparatus should be capable of moving the crossbar to a height of at least fifteen feet; I prefer seventeen feet or more.

Figure 3A:
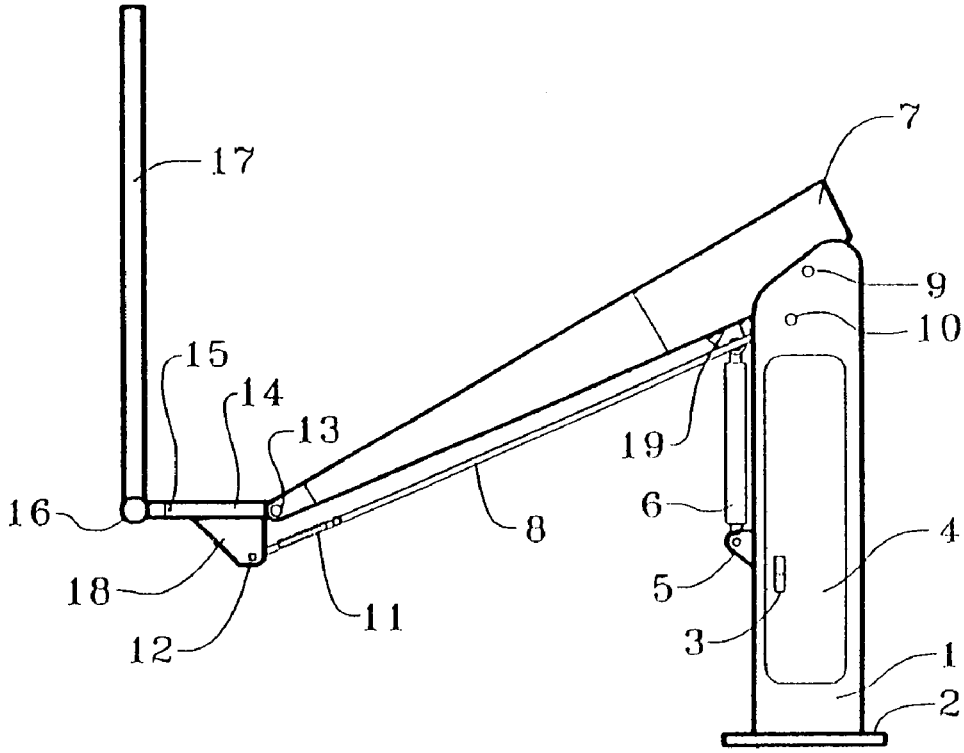
FIGS. 3*a* and 3*b* show the goal in the lowered position.
Figure 3B:
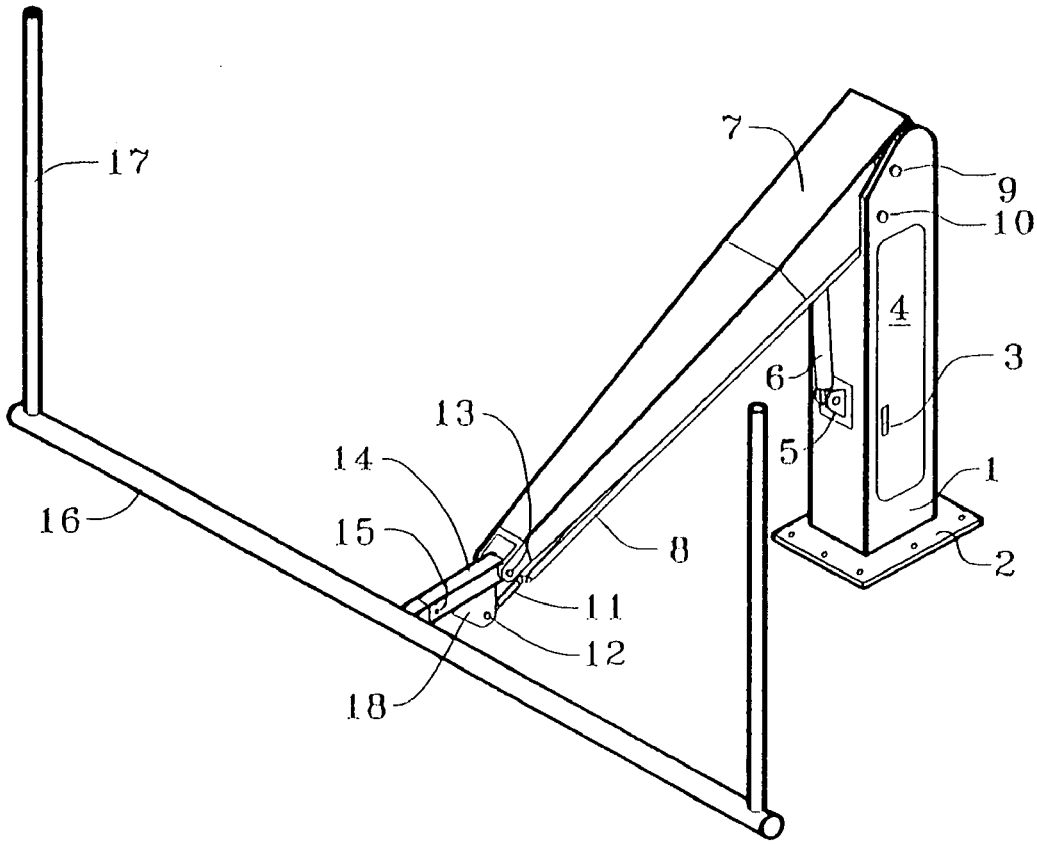

Referring now to FIGS. 3*a* and 3*b*, the apparatus is seen to be in the lowered position, main boom 7 having been lowered from the horizontal about 30 degrees. It should be observed that the hydraulic jack 6 is approximately parallel to vertical column 1, whereas it is angled slightly away from vertical column 1 in FIGS. 1*a* and 1*b*. When the apparatus is in the elevated position as shown in FIGS. 2*a* and 2*b*, hydraulic jack 6 is still slightly angled from vertical column 1, but not as much as when the apparatus is in the playing mode as in FIGS. 1*a* and 1*b*. In FIGS. 3*a* and 3*b*, the uprights remain vertical and nose boom 14 is horizontal, no adjustment being necessary in the length of control arm 8 because of the movement from fully elevated (as in FIGS. 2*a* and 2*b*) to completely lowered, as in FIGS. 3*a* and 3*b*.

Figure 4:
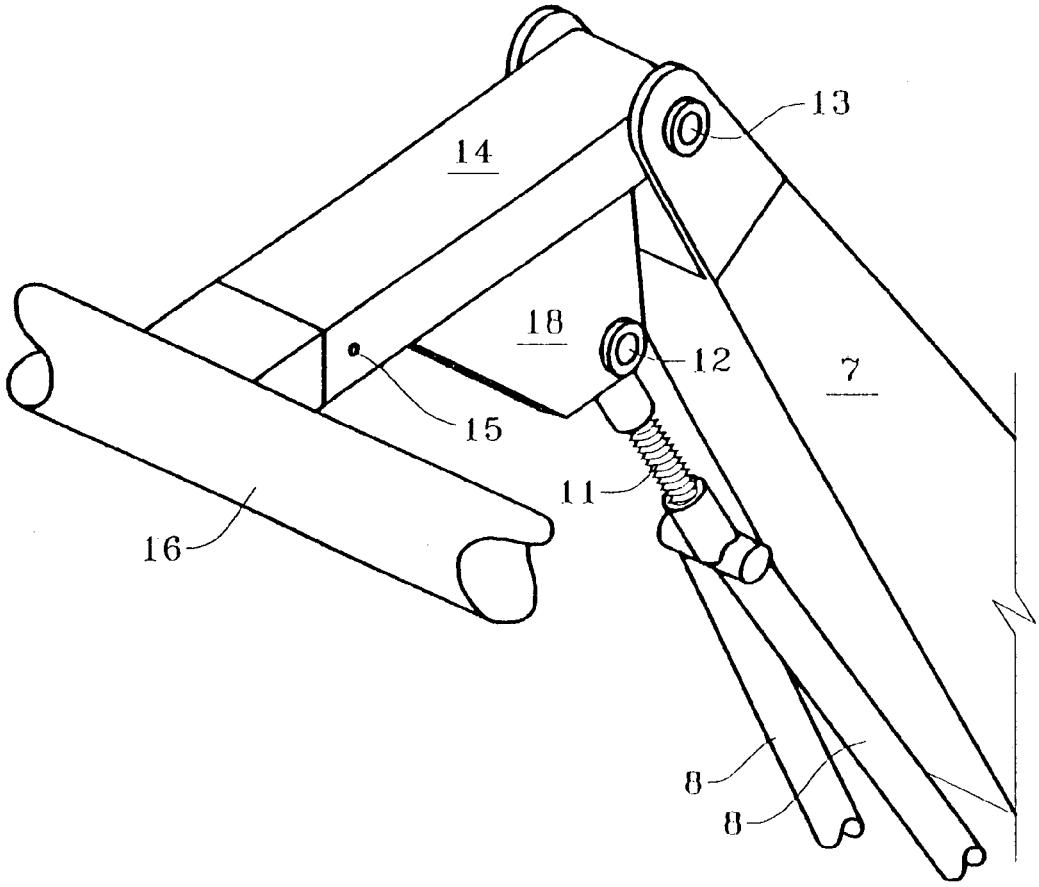
FIG. 4 is a detailed view of the nose boom assembly.

In FIG. 4, the nose boom 14 and associated parts are shown in detail. Pin 15 can be removed to separate the crossbar 16 from nose boom 14. Pivot 13, connecting main boom 7 and nose boom 14, together with pivot 12, connecting upper control arm bracket 18 and control arm 8, assures that nose boom 14 will be held substantially horizontal throughout the manipulation of the apparatus. If there is a slight deviation from the horizontal (which is readily detectable because the uprights 17 will not be vertical), an adjustment in the effective length of control arm 8 can be made by turning threaded insert 11 in one direction or the other. When the length of control arm 8 is coordinated with the effective length of main boom 7 (the distance between pivots 13 and 9), it can automatically assure that the nose boom 14 will remain horizontal and the uprights 17 are vertical regardless of the angular position of the main boom 7.

Since neither the elevated position nor the lowered position of the apparatus is normally used in the game, it may not be considered essential that the nose beam 7 remain strictly horizontal in those positions nor that the uprights extend exactly vertical; accordingly perhaps the only position for which some users may adjust threaded insert 11 will be the playing position shown in FIGS. 1*a* and 1*b*. But because of the positioning and close relationship of main boom 7 and control arm 8, an adjustment of the nose boom 14 to make it horizontal in the playing position will more or less automatically adjust the elevated and lowered positions also so that the nose boom 14 will be horizontal and the uprights 17 vertical.

Figure 5:
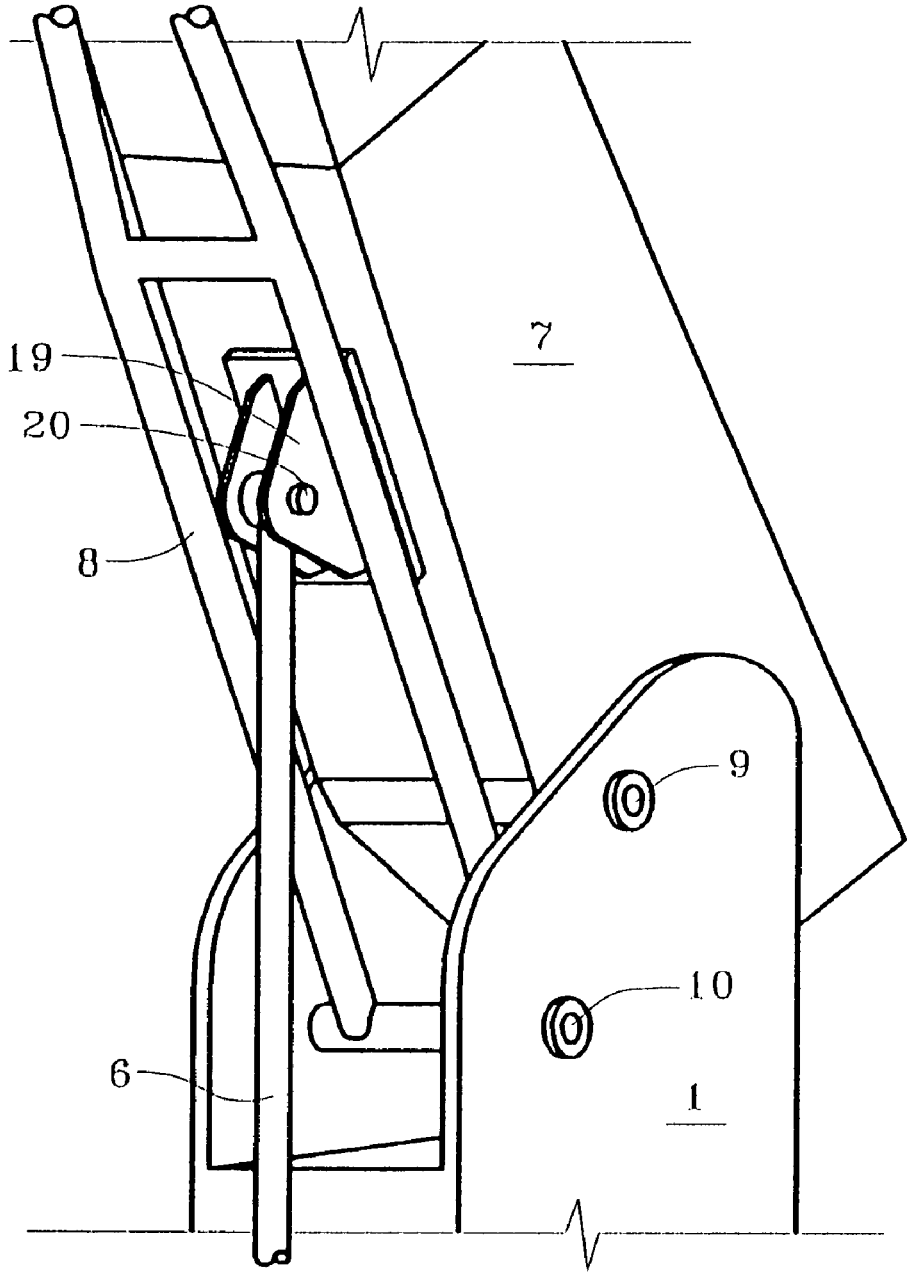
FIG. 5 details a hydraulic jack connection to the main boom.

The detail of FIG. 5 shows the articulation of main boom 7 in closeup fashion. Hydraulic jack 6 is connected at pivot 20 on upper mount 19, which is fixed to the main boom 7. Control arm 8 is situated on pivot 10 in vertical column 1. Also on vertical column 1 is pivot 9 for the main boom 7. The main boom 7 is elevated in this view, and accordingly if it were to be lowered to either the play or lowered position, hydraulic jack 6 would be retracted, pivoting on pivot 20, causing the main boom 7 to be pivoted downwardly on pivot 9 and also causing control arm 8 to be pivoted on pivot 10. The effective distances between pivots 9 and 10, and 12 and 13, are approximately equal, as are the effective distances between pivots 9 and 13 and pivots 12 and 10. This double pivoting relationship thus forms an approximate parallelogram with the four pivots as corners, which assures that the nose beam remains horizontal throughout any manipulation of the main boom 7.

Figure 6:
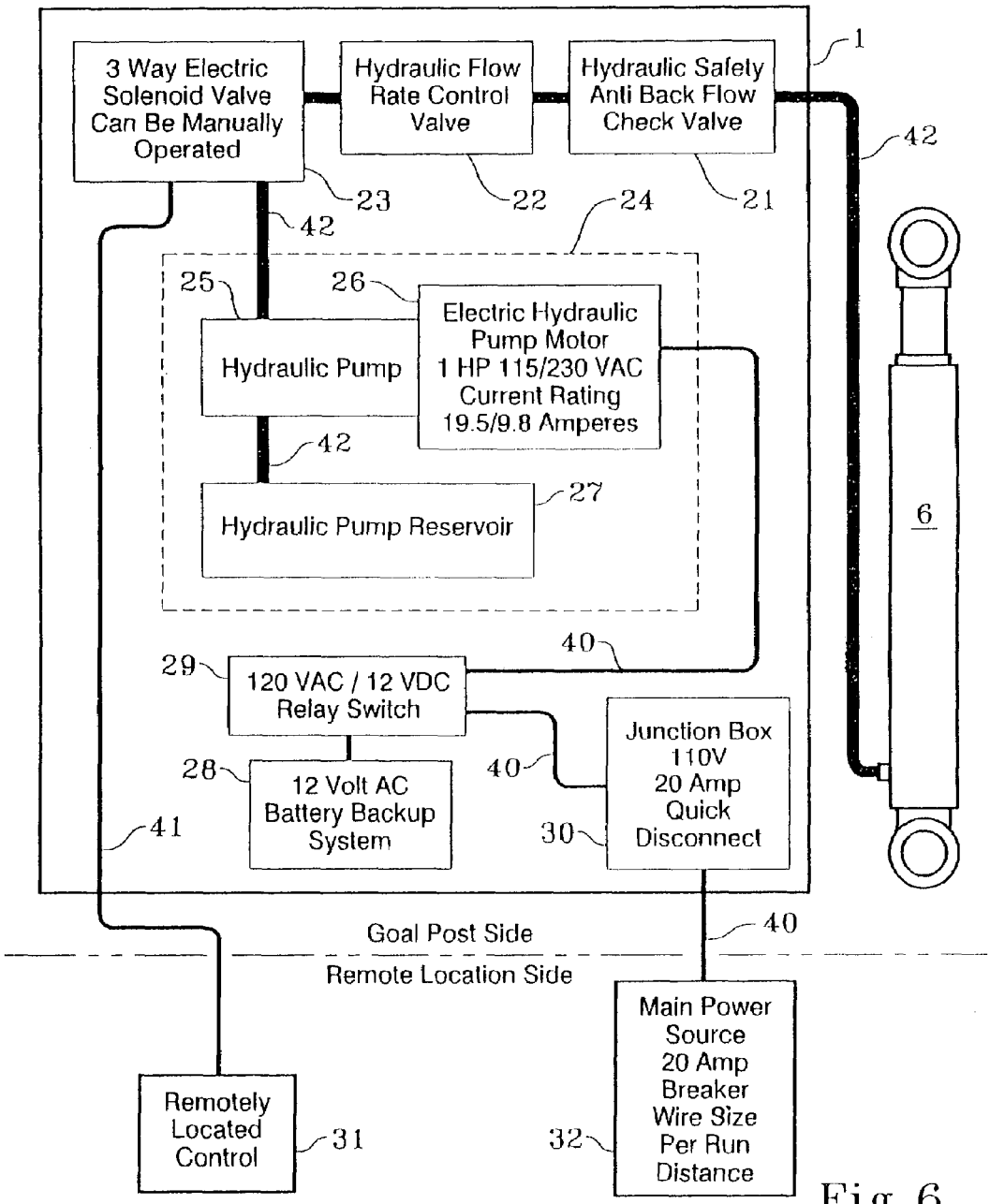
FIG. 6 is a schematic of the electrical and hydraulic systems.

The more or less diagrammatic FIG. 6 shows some power lines 40, electrical control connections 41, and hydraulic fluid lines 42. Hydraulic jack 6 is extended or retracted according to the direction of flow of hydraulic fluid, which in turn is determined by a remotely located hydraulic controller 31, normally operated by a human being. The reversible hydraulic pump 25, its associated electric pump motor 26, and the hydraulic fluid reservoir 27 are all located within the vertical column 1, designated here as 24, usually also together with a power junction box 30, receiving AC power from an external source 32, a battery backup 28, and a relay switch 29 for switching from AC to DC in an emergency, i.e. if the external power source is cut or otherwise becomes unavailable. A check valve 21 may be used to guard against sudden interruption of power, or pressure loss. The controller 31 is able to command the pump. Wires connecting controller 31 to the electric motor 26 and three-way solenoid valve 23 should pass underground to the field operator's location remote from the goal. Design and construction of the concrete substructure mentioned in connection with FIGS. 1*a* and 1*b* should provide a utility channel leading to the desired remote location for power source 32 and controller 31. Ideally, in this embodiment, the controller will have only three simple options—play, elevated, and lowered. The operator normally needs only to choose one of the three options and the control system will operate the hydraulic jack 6 accordingly. The controller may use a wireless system to communicate with the pump motor and/or other devices within vertical column 1.

Persons skilled in the art will recognize that any conventional hydraulic fluid may be used—that is, no special fluid is required, although of course it should have a low freezing point where freezing conditions may be expected. The system may be pneumatic—that is, the fluid may be air. As used herein, the terms "hydraulic" and "hydraulic fluid" means any fluid suitable for use in a positioning cylinder or other actuator such as hydraulic jack 6. Alternatively, the motion of main boom 7 may be accomplished by mechanical means through gears or other leverage applied directly from an electric motor, such as an electric actuator. Any sutiable device for applying force to cause main boom 7 to pivot on pivot 20 may be satisfactory; such a device—that is, the means for moving the main boom and, sometimes separately, the nose boom or the release mechanism, may be referred to herein broadly as an actuator.

It also may be observed that the nose boom is not essential if one is not concerned about the orientation of the uprights 17 as the apparatus is moved from the playing mode to the lowered or elevated mode. Also, it is not essential that the vertical column 1 be exactly vertical in orientation—it may "lean" either forward or backward, or may take the form of a pyramid or other support. My use of the term "vertical column" is intended to include any support that is capable of supporting the main boom 7 at a pivot 9. For example, one might, for whatever reason, wish to support the pivot 9 on a structure having two legs and a horizontal member with a bracket for holding pivot 9. Such a structure would be functionally and structurally equivalent to the vertical column illustrated herein and accordingly is intended to be included within the meaning of "vertical column." For my purposes, the pivot 9 will normally be at a height of about the same height as a regulation crossbar, or somewhat lower as is evident in FIG. 1*a*; this may be varied somewhat within the scope of my invention.

FIG. 7 shows an alternate configuration in which the hydraulic jack 31 is on the side of vertical column 1 opposite that of FIG. 1*a*, and pivot 38 on main boom 7 is leveraged somewhat differently from that of FIG. 1*a*. Hydraulic jack 31 pivots on pivot 37 and pivot 38; main boom 7 pivots on pivots 38 and 39, which is located on vertical column 1. In this illustration, it will be seen that there is no control arm 8, but there is a second hydraulic jack 32 connecting nose boom 35 with main boom 7. In the variation of FIG. 7, if one desires to maintain nose boom 35 horizontal at all times, it is necessary to coordinate the action of hydraulic jack 32 with that of hydraulic jack 31. If main boom 7 is elevated, hydraulic jack 32 will be retracted, and if main boom 7 is lowered, hydraulic jack 32 will be extended to assure that nose boom 35 remains horizontal. The controller in such a system will have somewhat more complexity than those of FIGS. 1-5, and a separate hydraulic line should be supplied to hydraulic jack 32.

The alternate construction of FIGS. 8-14 includes a vertical column 50, a hydraulic cylinder 51 pivoted at pivot 52, which is fixed to vertical column 50 and also pivoted at pivot 53 fixed to boom 54. Boom 54 is pivoted at pivot 55, which is also fixed to vertical column 50. Pivots 52, 53, and 55 are placed so that actuation of hydraulic cylinder 51 will raise or lower boom 54 depending on whether stem 56 is extended or retracted. Crossbar 57 is shown in side view in FIG. 8; the uprights normally attached to the crossbar are omitted from this view.

As with the variation of FIGS. 1-7, the variations of FIGS. 8-14 preferably are secured to a concrete substructure 30 such as illustrated in FIG. 7, having provision for electrical wiring for operating the actuators from a remote location. The goals should be operated independently at each end of the field. Vertical column 50 may contain power connections, pumps, switches and the like including remote control systems, similar to those described with respect to FIG. 6 and elsewhere herein. Alternatively, some or all of the pumps, switches, remote control systems and the like may be located within the concrete substructure 30.

Fixed to the boom 54 is a hook latch 58 which is interlocked with a similar hook latch 59. Hook latch 59 is a part of stabilizing panel 60. Stabilizing panel 60 is pivoted at pivot 61. When the hook latches 58 and 59 are joined or interlocked as shown, the boom 54 is held steady, maintaining the crossbar 57 at the correct height for regulation play. Present NCAA (National Collegiate Athletic Association) rules, for example, require a height of ten feet.

Figure 8:
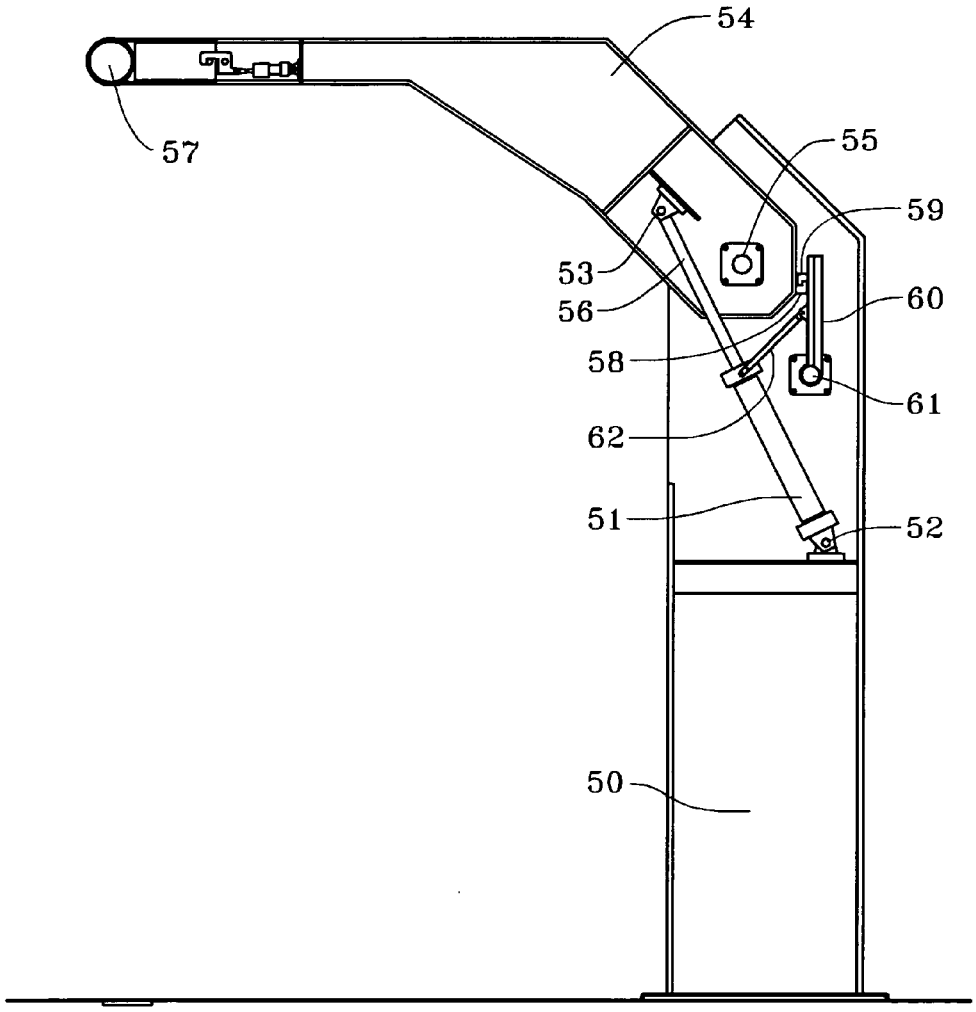
FIG. 8 is a further alternate construction, showing a single hydraulic cylinder for operating the main boom, the main boom being held in place by a latch.
Figure 9:
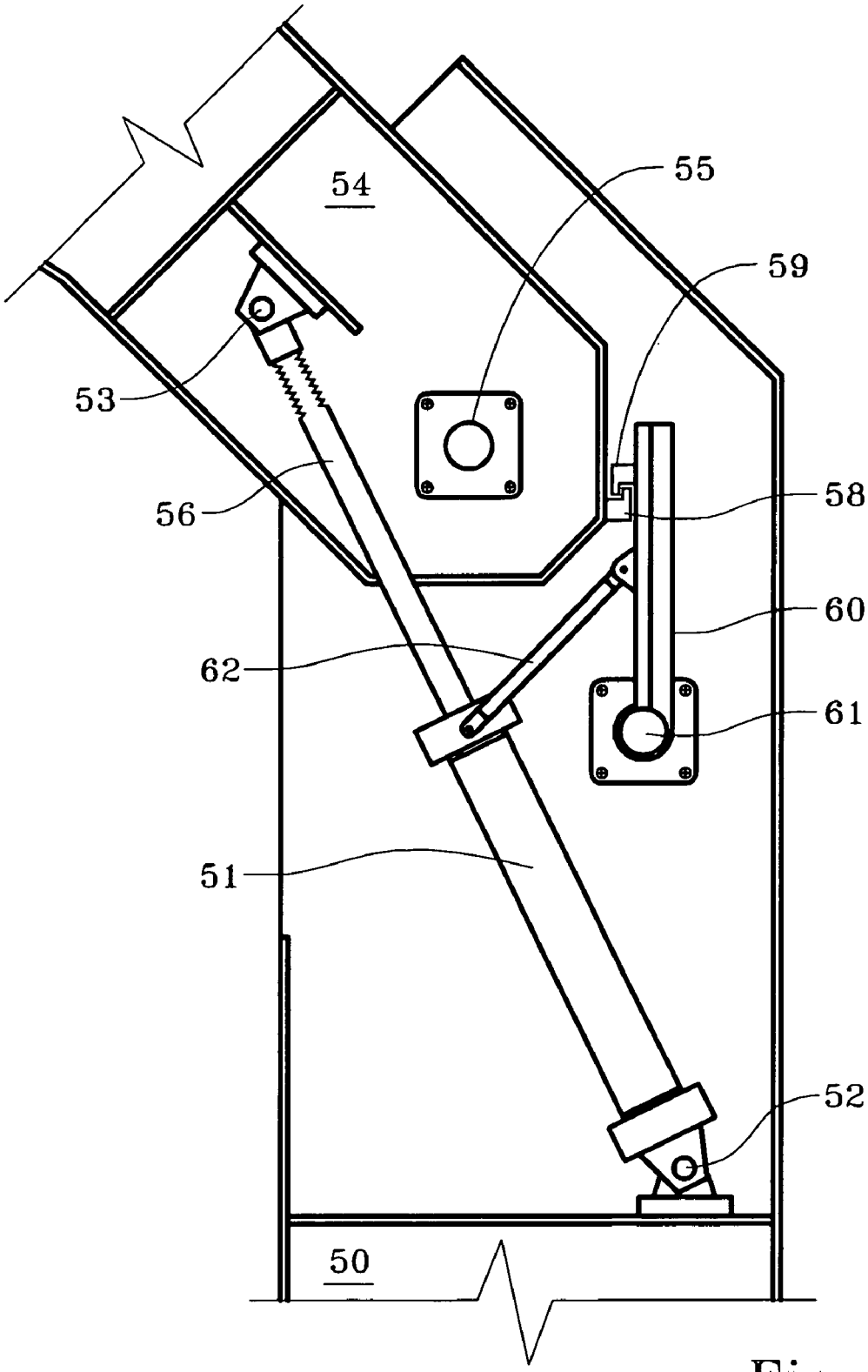
FIG. 9 shows some detail of the hydraulic cylinder and latch assembly.

Referring now to FIG. 9, the portion of FIG. 8 including hydraulic cylinder 51 is seen to be enlarged and the interlocked state of hook latches 58 and 59 may be observed. Spring loaded arm 62 will urge stabilizing panel 60 in an upward and rightward (as depicted) direction when cylinder 51 is actuated to elevate boom 54, thus disengaging hook latches 58 and 59 as explained further with reference to FIG. 10.

Figure 10:
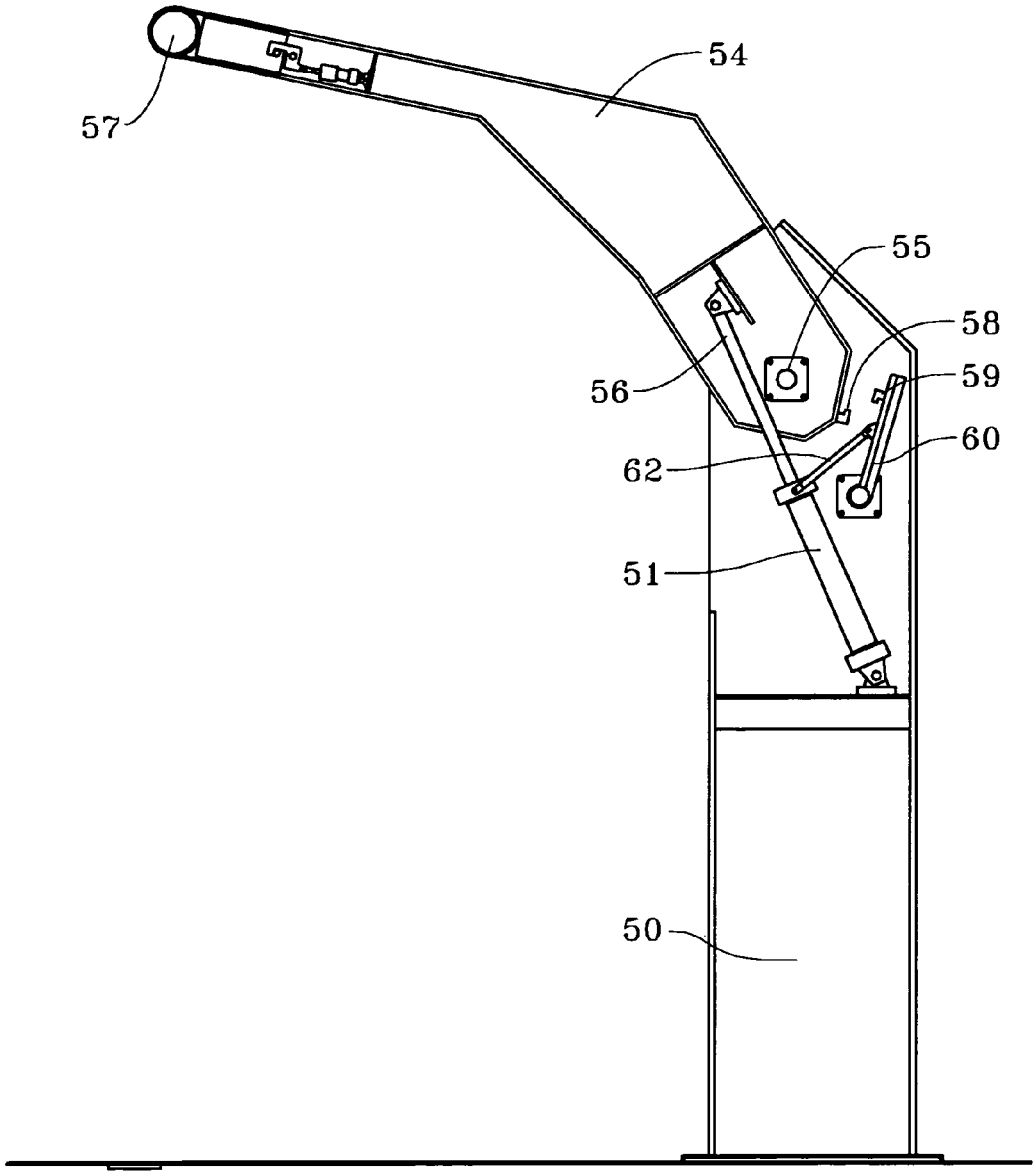
In FIG. 10, the variation of FIG. 8 is shown wherein the latch has been released.

In FIG. 10, actuation of the hydraulic cylinder 51 to extend stem 56 has resulted in the elevation of boom 54, pivoting on pivot 55. The movement of boom 54 also causes latch 58 to disengage from hook latch 59, and arm 62 has moved panel 60 to clear the two latches 58 and 59; boom 54 can then be lowered. The hydraulic cylinder 51 can then be retracted, causing boom 54 to pivot downward on pivot 55. Actuation of hydraulic cylinder 51 thus performs two functions—it not only moves boom 54, but also disengages latches 58 and 59, permitting the boom to be turned downward.

Figure 11:
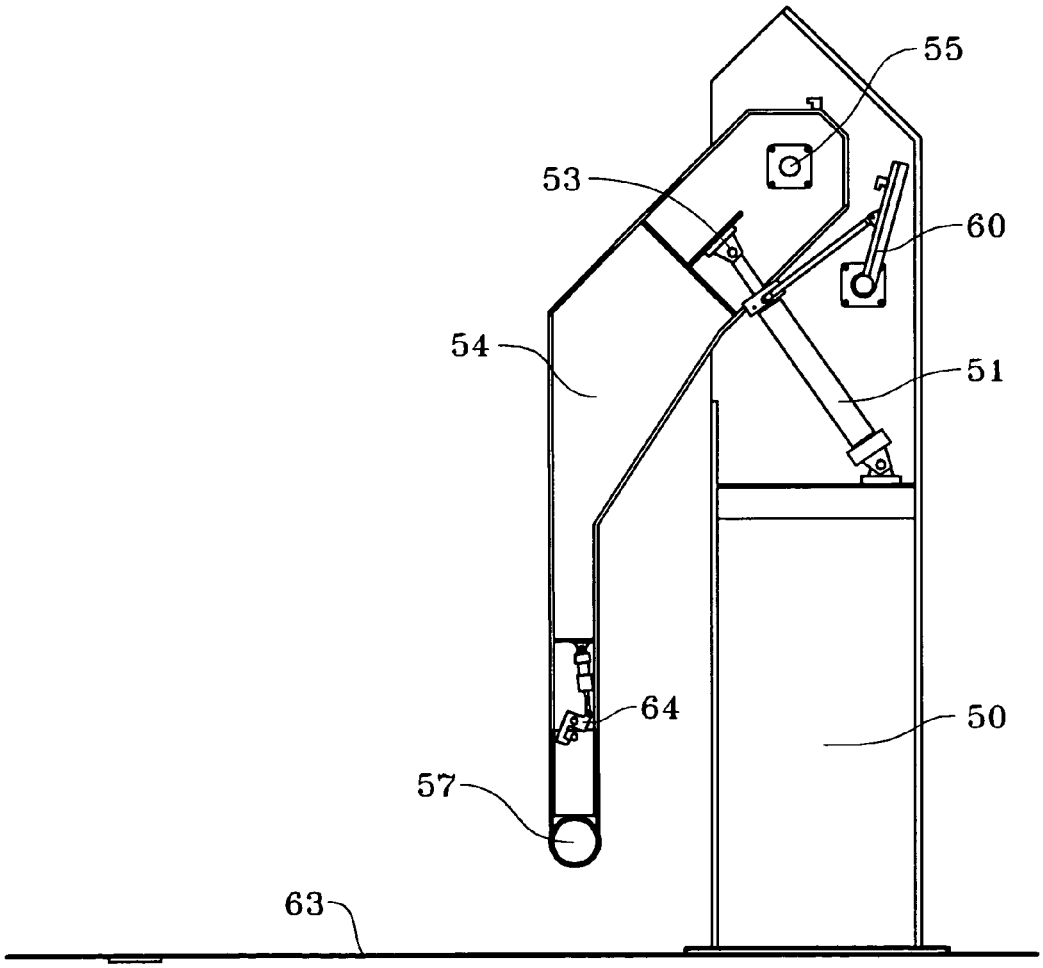
In FIG. 11, the boom is lowered to permit removal of the crossbar.

As seen in FIG. 11, boom 54 is now substantially vertical, and crossbar 57 is very near to the field 63. The uprights, not depicted here, extend substantially parallel to the field. Also seen in FIG. 11 is the position of crossbar retainer hook 64 within the boom 54 and near its end. This device is described further in FIGS. 12 and 14.

Figure 12:
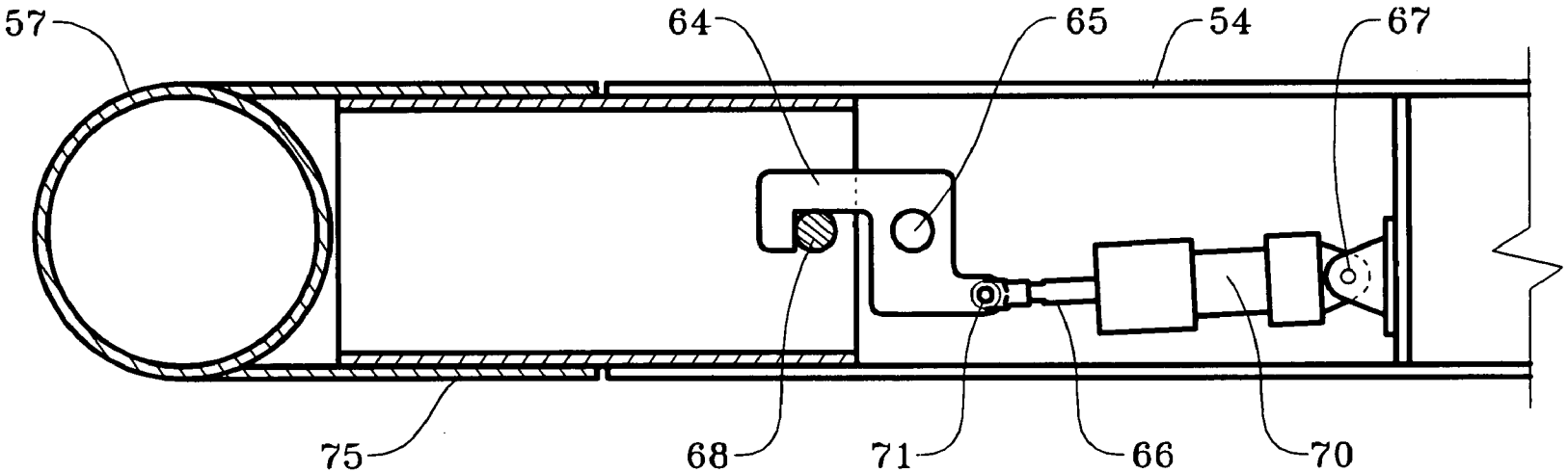
FIG. 12 is a side elevational view of the sacrificial crossbar hold and release mechanism.

Referring now to FIG. 12, crossbar retainer hook 64 is located more or less centrally within boom 54. It is seen here to be pivoted at pivot 65, fixed to boom 54. Stem 66 extends from a small hydraulic cylinder 70 for attachment to crossbar retainer hook 64 at 71. Hydraulic cylinder 70 is attached to boom 54 at pivot 67. Hydraulic cylinder 70 is actuated remotely, preferably by a system which will prevent actuation of cylinder 70 at any time except when boom 54 is in the position of FIG. 11. Crossbar 57 is attached to crossbar neck 75, part of which is inserted into boom 54 (seen in detail in FIG. 14). Crossbar neck 75 is retained within boom 54 by hook 64 which is engaged with pin 68. Actuation of hydraulic cylinder 70 will cause crossbar retainer hook 64 to move and disengage from pin 68.

Figure 13A:
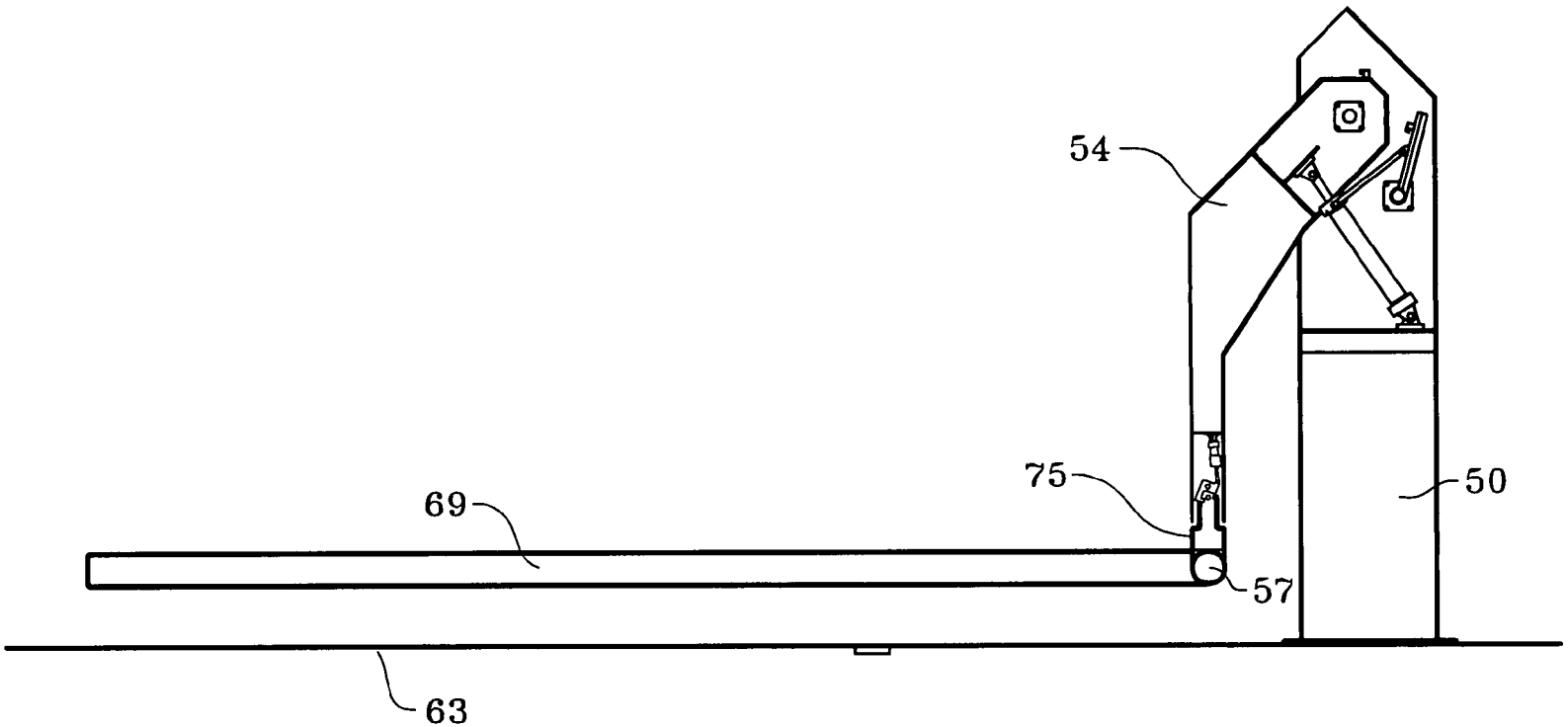
FIG. 13*a* shows the goal in the lowered position.
Figure 13B:
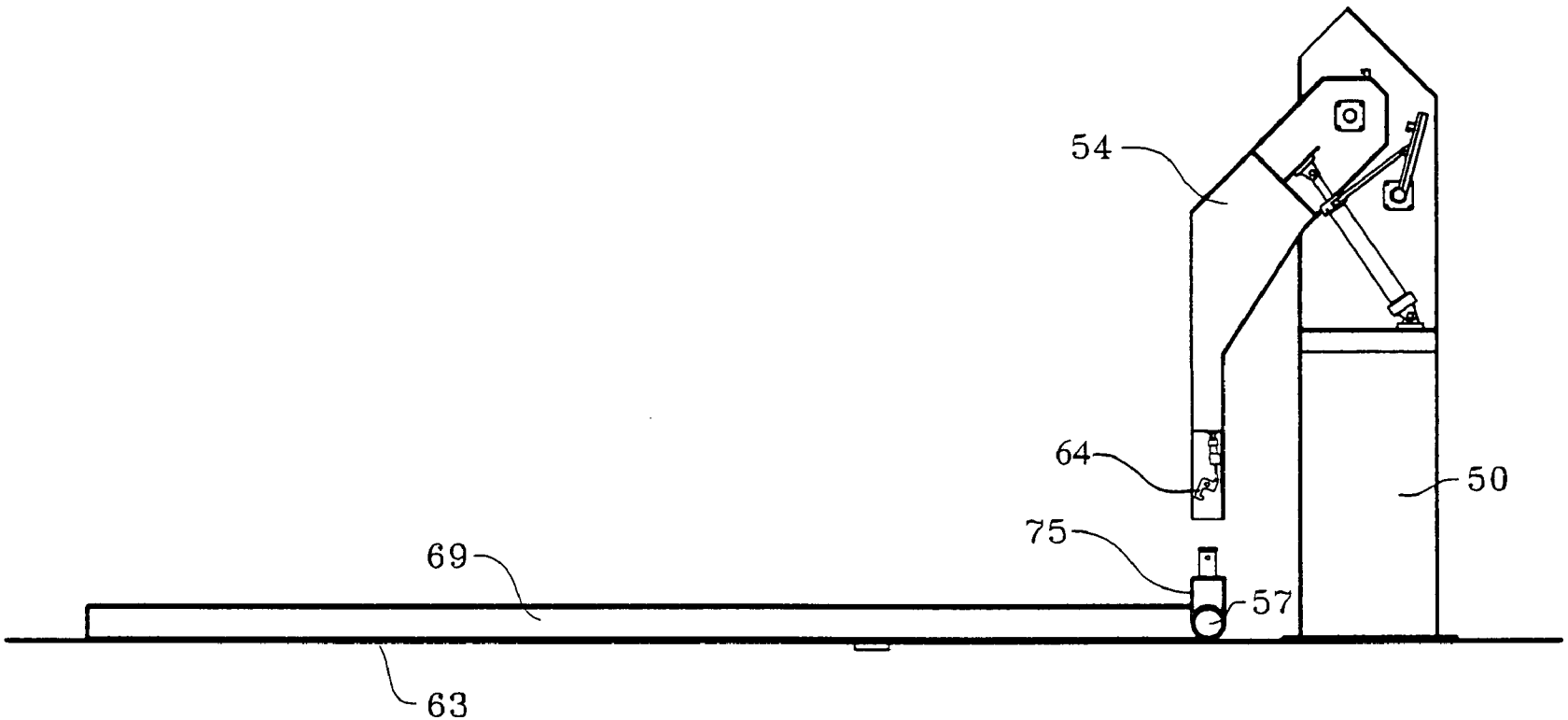
In FIG. 13*b*, the crossbar assembly has been released and lies on the field.

FIG. 13*a* shows the position of the boom 54, the crossbar 57, and uprights 69 prior to the release of the crossbar 57 and uprights 69. Uprights 69 are seen to be substantially parallel to the field 63. In FIG. 13*b*, the pin 68 has been released from its hold by crossbar retainer hook 64; since it is no longer engaged by hook 64, the crossbar neck 75 has fallen from the end of boom 54, and the crossbar 57 and uprights 69 are now on the field 63. If the spectators remove the crossbar assembly, a replacement crossbar assembly is easily inserted into the boom as in FIG. 14.

Figure 14:
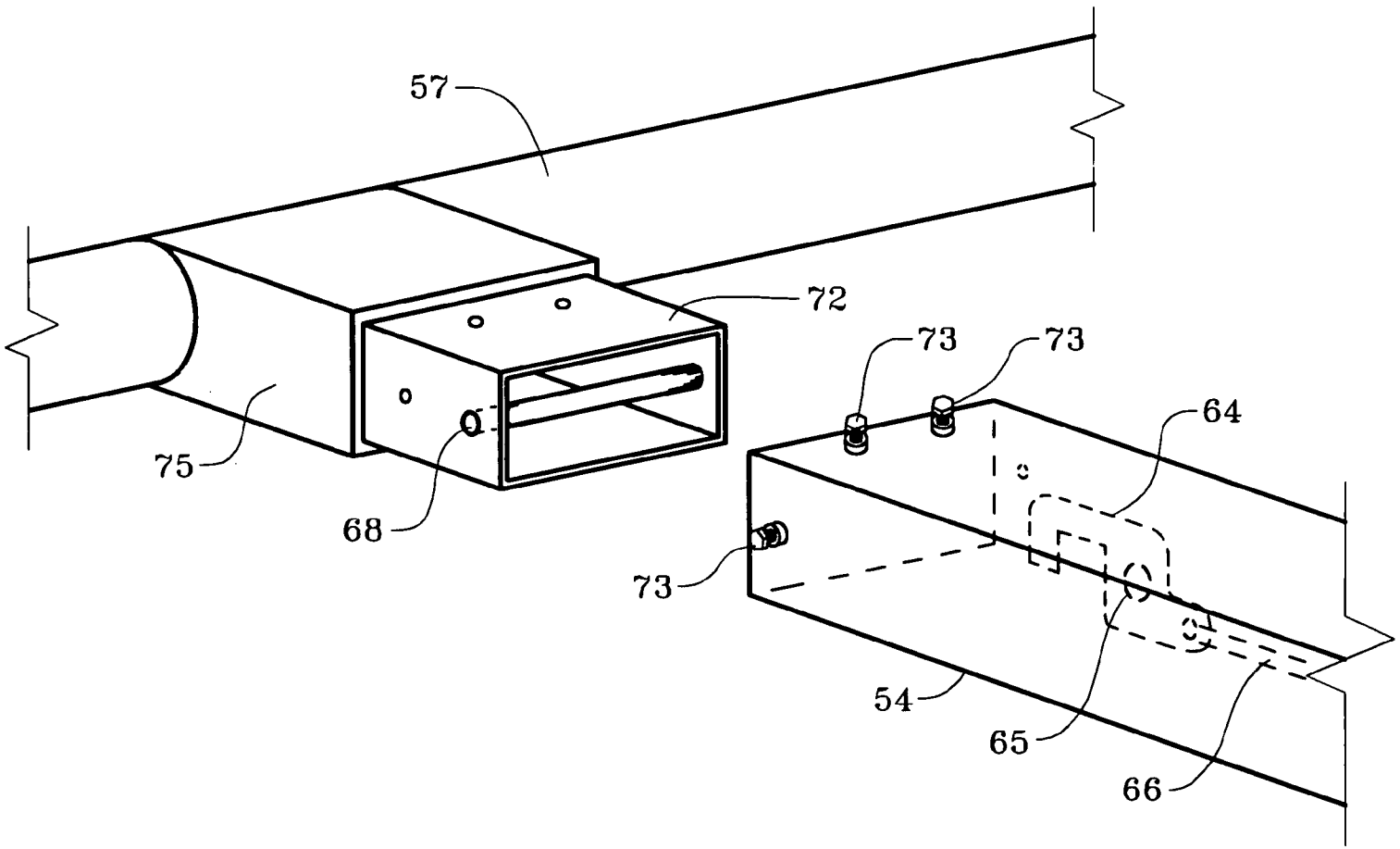
FIG. 14 shows the crossbar neck in a position for inserting into the end of the boom.

FIG. 14 illustrates in perspective the positioning of neck 75 for connection to boom 54. Neck 75 is seen to be welded or otherwise attached to crossbar 57 and has a neck extension 72 slightly smaller in dimension than the interior of the end of boom 54. Neck extension 72 may be slightly tapered to facilitate insertion and removal, preferably on the lower side (as depicted) or the upright sides (as depicted) rather than the upper side in order to help adjust the height of the crossbar 57 to regulation height. The boom 54 may be provided with set screws 73 or other devices to help secure and adjust the position of the crossbar 57 after insertion of the neck extension 72. Within the neck extension 72 is pin 68. Pin 68 is positioned for engagement with hook 64 for retention of the neck extension 72 in place in the boom 54. As described above, hook 64 is manipulated from a remote location by activating cylinder 70 (see FIG. 12). Pin 68 and hook 64 may be replaced with any apparatus capable of retaining and releasing the crossbar/neck assembly from the boom from a remote location. Pin 68 may be considered more broadly as providing a stationary retaining surface in or on the neck of the crossbar and upright assembly, and hook 64, located in a goal holder or support such as, for example, the boom 54, more broadly provides a movable retaining surface complementary to, and for engagement with, the stationary retaining surface in or on the neck.

Therefore, it may be understood that my invention includes an articulating goal post for a football field comprising (a) a vertical column, (b) an arm pivoted thereon (c) a crosspiece near the end of the arm, and (d) upright members attached to the ends of the crosspiece. In another aspect, my invention includes a goal post comprising a vertical column having a base, a pivoted arm thereon, a crosspiece near the end of the pivoted arm, and two upright members, the upright members and the crosspiece defining a regulation kicking goal when the goal post is in a playing position, and means for moving the crosspiece and the upright members by the pivoted arm to an elevated position wherein the crosspiece is at least fifteen feet above the base. In yet another aspect, my invention is a football goal post comprising a crossbar, upright members on the ends of the crossbar, a nose boom rigidly connected to the crossbar, a main boom having a forward end and a rear end, the main boom being pivotally connected to the nose boom at the forward end, a vertical column including a pivot connecting the rear end of the main boom to the vertical column, a hydraulic jack pivotally mounted on the vertical column and pivotally connected to the main boom, and a substantially rigid control arm pivotally connecting the nose boom and the vertical column. In another aspect, my invention is a football goal comprising (a) a substantially vertical column, (b) a main boom attached in pivotal relation to the substantially vertical column, (c) an actuator for positioning the boom upwardly or downwardly, and (d) a crossbar and upright assembly including a releasable attachment to the end of the boom.

In another aspect, my invention includes an articulating football goal comprising a vertical column, a boom movably attached to said vertical column, said boom holding near its end a crossbar and uprights to form a goal when maintained at a height suitable for regulation football, said boom being movable by at least one actuator to lower said crossbar and uprights to near field level, and means for releasing said crossbar from said boom; this aspect may include a movable retaining member in said boom for engagement with said stationary retaining member in said neck, and an actuator in said boom for activating said movable retaining member to release said neck from attachment to said boom. In another aspect, my invention is a crossbar and upright assembly for a football goal comprising (a) a crossbar having uprights on the ends thereof, said crossbar and uprights being of dimensions compliant with football rules, and (b) a neck on said crossbar, said neck being attached substantially centrally on said crossbar and in a plane about 90 degrees from the plane of said uprights, said neck including a retaining surface for releasable engagement with a complementary retaining surface in a holder for said crossbar and upright assembly. My invention also entails an athletic goal comprising (a) a substantially vertical column, (b) a boom including a vertical column end and a remote end, said boom being attached at its vertical column end in pivotal relation to said substantially vertical column, (c) an actuator in said athletic goal for moving said boom, and (d) a crossbar and upright assembly including a releasable attachment member for attachment of said assembly to the end of said boom; as with the other variations, this aspect of the invention may include a remotely operable release actuator within said boom for releasing said releasable attachment. In addition, my invention includes a football field including two goal posts at least 100 yards apart, said goal posts each comprising a vertical column, a boom articulated thereon and operable from a remote location, and a detachable crossbar and upright assembly releasable retained on said boom, whereby said crossbar and upright assembly may be lowered for release thereof onto said football field.

My invention may be otherwise varied within the scope of the following claims.

The invention claimed is:

1. An articulating football goal comprising a vertical column, a boom movably attached to said vertical column, said boom holding near its end a crossbar and uprights to form a goal when maintained at a height suitable for regulation football, said crossbar including a neck thereon for attachment to said boom and including a releasable stationary retaining member in said neck for retaining said neck in attached relationship to said boom,said boom being movable by at least one actuator to lower said crossbar and uprights to near field level, and means for releasing said crossbar from said boom.

2. The articulating football goal of claim 1 wherein said at least one actuator is controlled from a remote location.

3. The articulating football goal of claim 1 wherein said at least one actuator is a hydraulic actuator.

4. The articulating football goal of claim 1 including a movable retaining member in said boom for engagement with said stationary retaining member in said neck, and an actuator in said boom for activating said movable retaining member to release said neck from attachment to said boom.

5. A football goal comprising (a) a substantially vertical column, (b) a boom including a vertical column end and a remote end, said boom being attached at its vertical column end in pivotal relation to said substantially vertical column, (c) an actuator in said football goal for moving said boom, and (d) a crossbar and upright football goal assembly including a releasable attachment member for attachment of said assembly to the end of said boom, said releasable attachment member comprising a retaining surface for engagement with a complementary retaining surface within said boom.

6. The football goal of claim 5 including a releasable latch for holding said boom at a predetermined level.

7. The football goal of claim 5 wherein said actuator comprises a hydaulic actuator.

8. The football goal of claim 5 wherein said releasable attachment member comprises a neck releasably inserted into the end of said boom.

9. The football goal of claim 8 including a hook within said boom for engaging said releasable attachment member.

10. The football goal of claim 9 including an actuator within said boom for actuating said hook.

11. The football goal of claim 5 including a remotely operable release actuator in said boom for releasing said releasable attachment member.

12. The football goal of claim 8 wherein said neck is slightly tapered.

13. The football goal of claim 8 including set screws in said boom for engagement with said neck when it is inserted in said boom.

* * * * *